United States Patent [19]

LaValley, Sr.

[11] Patent Number: 5,064,347

[45] Date of Patent: Nov. 12, 1991

[54] PRESSURE RESPONSIVE FLUID PUMP SHUT OFF AND ALARM SYSTEM

[76] Inventor: Ronnie L. LaValley, Sr., 5856 Mogg Rd., Prescott, Mich. 48756

[21] Appl. No.: 617,669

[22] Filed: Nov. 26, 1990

[51] Int. Cl.[5] ..... F04B 49/08

[52] U.S. Cl. ..... 417/9; 417/12; 417/18; 417/38; 417/44; 417/53; 417/63

[58] Field of Search ..... 417/9, 12, 18, 36, 38, 417/44, 53, 63

[56] References Cited

U.S. PATENT DOCUMENTS 2,430,257 11/1947 Teeson ..... 417/12

4,290,735 9/1981 Sulko ..... 417/12

*Primary Examiner*—Richard A. Bertsch

*Assistant Examiner*—David W. Scheuermann

*Attorney, Agent, or Firm*—Learman & McCulloch

[57] ABSTRACT

A pump supply system for furnishing well water or the like which is sensitive to and operates within a range defined by a pressure switch to supply water when pressure in the system falls below a preset minimum pressure and shut off the pump when the pressure reaches a predetermined value. Timing means is employed in the system and preset to time out after a predesignated interval of operation of the pump. The system will retime the next pumping cycle, if that interval of operation is not exceeded. If the pump seeks to operate beyond the predesingated time period, the timing circuit is disabled, the pump is shut down, and an alarm is activated.

6 Claims, 1 Drawing Sheet

PRESSURE RESPONSIVE FLUID PUMP SHUT OFF AND ALARM SYSTEM

This invention relates to electrically powered, liquid circulating systems of the type used, for example, in a well water pump system, located either above ground or in a submerged position, to furnish water for domestic, business or other uses.

BACKGROUND OF THE INVENTION

Considerable water damage can be done to a building when there are ruptured water lines, or various appliances or fixtures develop a leak problem, and the pump operates continuously to maintain the pressure in the water supply system Conventional water pumps of the type used for cottages and homes in rural areas where pressurized city water supply systems are not available are energized when the pressure in the system reaches a predetermined minimum pressure and then are deenergized when the pressure in the water line system reaches a predetermined maximum value. Not only is water damage to the building and the various appliances, fixtures, and products a problem in this situation, the continuous operation of the pump will, also, prematurely wear out the pump and waste electrical energy.

Numerous attempts have been made to energize an alarm system when leaks in the water supply sytems are detected and applicant is aware of the following prior U.S. Pat. Nos. 2,990,780 Kreuer; 3,044,402 Kreuter; 3,050,003 Edwards; 3,148,622 Le Van et al; 3,2299,817 Walters et al; 3,365,710 Duplessy; 3,473,549 Moyer; 4,797,666 Baxter et al. None of these patents have solely or combinatively, suggested the system and method which will be described and claimed, and none provide a system which is as simple and trouble free as the system which will be described.

In Baxter U.S. Pat. No. 4,797,666, a pair of timers are utilized to indicate a catastrophic flow conditon. The method involved does not provide a timing circuit wherein a predetermined operation of the pump is timed and the timer will automatically retime the next cycle, while, if the predesignated time cycle of operation is exceeded, the pump is shut down, and an alarm system is energized, until the system is manually reset. The other patents noted, similarly do not teach the system and method to be described.

SUMMARY OF THE INVENTION

One of the prime objects of the present invention is to provide a pump supply system wherein timing means is preset to time out, with a predesignated interval of operation of a pump which is operative between predetermined minimum and maximum pressures it senses in the water line system, and then automatically retimes the next pumping cycle, if the pump operates within the preset time period. When the pump operation exceeds this predesignated time period, the timing circuit is inactivated, and, rather the pump is shut down and an alarm energized.

A prime object of the invention is to provide a relatively simply, inexpensive safety system of the type identified which can be manufactured and sold as a single unit, ready to install in an existing system, or when a new water supply system is installed.

A further object of the invention is to provide a pumping system of the character described which is controlled by the consumer, is compact and easy to adjust, and which incorporates a solid state time delay relay encased in a plastic enclosure so as to be protected from moisture.

Still another object of the invention is to protect consumers having such pump-supplied systems from damage due to broken water lines or leaks in appliances or fixtures, such as water pressure tanks, water heaters, toilets, boiler-type furnaces, hot water heat registers, washing machines, water softeners and other products that may develop a leak and bleed the system which the pump supplies.

Still another object of the invention is to protect such a consumer from the expense of premature water pump repair, and prevent the unnecessary and costly waste of precious water and electrical energy.

Other objects and advantages of the invention will be pointed out specifically, or will become apparent from the following description when it is considered in conjunction with the appended claims and the accompanying drawings.

GENERAL DESCRIPTION

Figure 1:
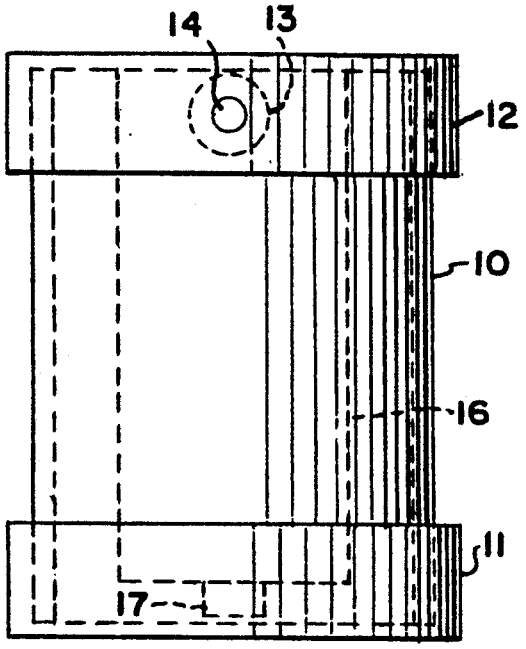
FIG. 1 is a side elevational view of a unit constructed according to the invention.

Referring now more particularly to the accompanying drawings, in FIG. 1, I have shown a cylindrical housing generally designated 10, which has a bottom cap or base 11, and a top cap 12. The bottom cap 11 is readily removable and may be held in place frictionally or by suitable set screws, or the like. Cap 12 includes a sealed wire entry opening 13, and may mount an alarm lamp 14. Alternatively, or additively, an audible alarm can be substituted or connected in circuit with the alarm lamp 14.

Figure 3:
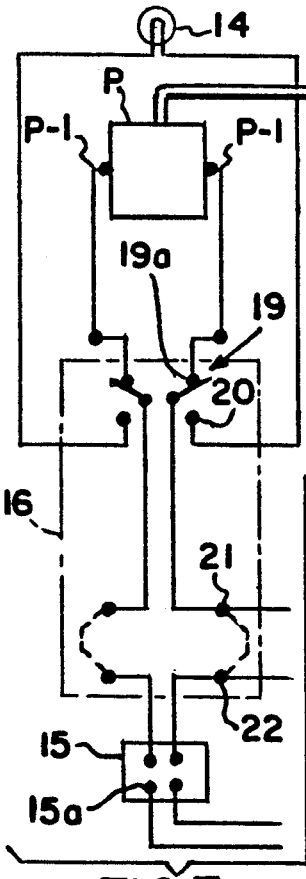
FIG. 3 is a schematic electrical diagram illustrating normal operation of the system.
Figure 4:
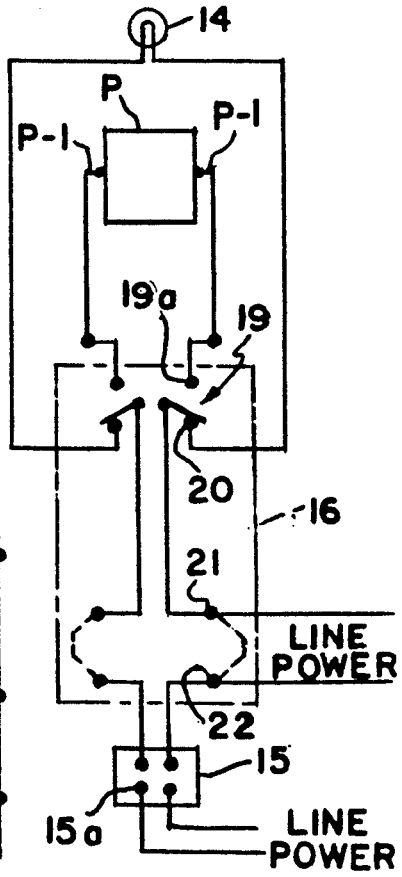
FIG. 4 is a similar diagram, with the switch components in a position in which the pump and timer are shut down, and the alarm energized.

Typically, the members 10–12 are constructed of a moisture-impervious plastic, such as polyvinylchloride, so that the interior of the unit remains moisture free. The unit typically may be mounted on a pumphouse wall next to the pump, or in any other accessible position. The pump P, shown schematically in FIGS. 3 and 4, is the typical, commercially available pump, which incorporates a pump pressure switch 15 of the type which senses the pressure in the water supply system and, for example, turns the pump on to pump water at a pressure of 20 psi and shuts it off when a pressure of 40 psi is reached. Pumps of this type are so well-known that no further description of them is necessary. Typical pumps are manufactured by Gould and Wayne companies and a typical pressure switch is manufactured by Square D Company.

Housed within the sealed enclosure 10 is a time delay relay device which comprises a solid state digital timing circuit with an electro-mechanical relay. Solid state switching devices of this type are normally encapsulated in an epoxy resin for protection and have been used to provide time delays of a predesignated period. They are referred to as "delay on make" timers. Such devices are available, for example, from National Controls Corporation, a subsidiary of Tokheim Corp. of Chicago, Ill., which markets such time delay relays combining solid state digital timing circuits with electro-mechanical relays, under designation numbers A1, T1, and K1.

Figure 5:
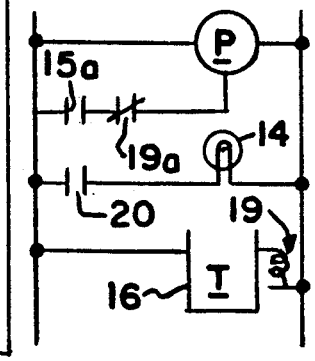
FIG. 5 is a further schematic electrical diagram of the circuit.

The devices or units 16 include rotatable dials 17 with pointer indicators 17*a* operating in conjunction with indicia 18 (i.e. 15, 30, 45, and 60) provided on a fixed wall 18*a* of the device 16. The circuit, FIGS. 3–5, includes lamp 14, pump Terminals P-1, pressure switch sensor contacts 15*a*, and relay 19 with normally closed contacts 19*a*, and normally open contacts 20. Also incorporated are line voltage input terminals 21 and 22 which connect to a power source such as 110 volt AC power. The schematic diagram, FIG. 5, depicts the operation of the circuit.

THE OPERATION

Figure 2:
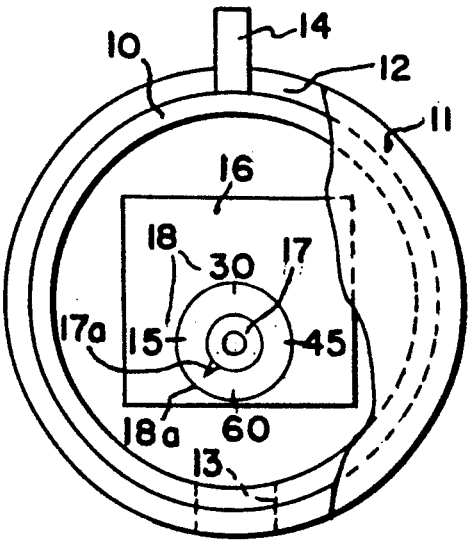
FIG. 2 is an under plan view thereof, with the bottom cover partially broken away to expose the control which is set by the consumer to a predesignated operation of his or her particular pump in the particular building with which he or she is concerned, to supply the appliances and fixtures which are present in the building.

If the home owner or consumer, at his particular facility, determines that fifteen minutes is a proper predesignated maximum time within which the pump P should pump to bring the system up to maximum shutoff pressure, i.e., 40 psi, he can then turn dial 17 from the position in which it is shown in FIG. 2 to the fifteen minute position indicated where it remains.

When the pump pressure switch 15 senses that the water pressure in the system has fallen below a predetermined minimum, i.e., 20 psi., its contacts 15*a* close or are activated and pump P is energized to pump water through the water supply system 23 to appliances A in building B. The application of voltage to the input terminals of the timing device 16, which typically utilizes a timing resistor, begins the timing cycle. At the end of the cycle or predetermined period, if that end is reached, the pump P is disconnected from the source of power via relay 19 which effects opening of the normally closed contacts 19*a* and closing of the contacts 20, even though sensor switch contacts 15*a* remain closed. Assuming the pump P operates for a time less than fifteen minutes, however, so that the timer 16 does not time out, the loss of power or voltage via opening of the switch contacts 15*a* of pump pressure switch 15, simply deenergizes pump 15. Lamp 14, as FIG. 3 indicates, remains deenergized with this operation and subsequent operations of the pump in which the predesignated time of fifteen minutes is not exceeded. If, however, the predesignated time of fifteen minutes, or whatever predesignated time is preset, is exceeded, the now closed contacts 20 energize lamp 14 and prevent the operation of the pump because relay contacts 19*a* are now open. This prevents further operation or cycling of pump P so that any line rupture or leak can have only a minimal affect. Only after the electromagnetically operated relay 19 is manually, in effect, reset to close contacts 19*a* by manually operating a breaker at the circuit box, for instance, to momentarily iterrrupt the power supply to the relay 19 so relay contacts 19*a* and 20 return (spring back) to closed and open positions, respectively, is the device again ready for operation.

Although preferred embodiments of the invention have been illustrated in the accompanying drawings and described in the foregoing detiled description, it will be understood that the invention is not limited to the embodiments disclosed, but is capable of numerous rearrangements, modifications and substitutions of parts and elements without departing from the spirit of the invention which is defined in the following claims.

WHAT IS CLAIMED IS:

1. A pressure responsive pump shut off and alarm system for buildings having water use appliances and components supplied by the pump through a water line comprising:

a. A water line connected to water using appliances;

b. A normally inactive pump system, responsive to a minimum pressure in the water line to become operative to pump water from a well, or other supply source, and responsive to a maximum predetermined pressure to be rendered inoperative;

c. Interval timing means, settable to time for a predetermined period, connected to said pump to monitor the time of operation of said pump when it is activated to pump water and to automatically retime for a subsequent operation of said pump if said predetermined interval is not exceeded; and d. a manually resettable component operable to deenergize said interval timing means and pump if said period is exceeded.

2. The system of claim 1 in which an alarm is connected in circuit with said timing means, and is automatically activated if said period is exceeded.

3. The system of claim 1 in which said component is reset by momentarily interrupting the supply of electrical power thereto.

4. The system of claim 1 in which said timing means and component are mounted in a sealed enclosure having a removable cap.

5. In a method of preventing undue damage to buildings having a water use system with components supplied by a normally deenergized pump which is responsive to a minimum water pressure in the system to become operative to pump water from a well or other supply source, and responsive to a maximum predetermined pressure to be rendered inoperative, the system having interval timing means settable to time the time of operation of said pump during a time period chosen as the maximum time the pump should operate to supply water to the system and automatically retime subsequent operations of said pump for the set interval so long as the maximum time period is not exceeded in the immediately preceding cycle, the system also having a manually resettable component, responsive to timing out of the interval timing means, connected therewith and with the pump to inactivate the timing means and shut down the pump, the steps of:

a. setting the timing means to begin timing when the pump is activated and to time the operation of the pump for a period corresponding to normal cycle of operation of the pump to supply water to the water system of the particular building involved;

b. automatically retiming subsequent cycles of operation of said pump for the interval set so long as the maximum time period is not exceeded in the immediately preceding cycle;

c. shutting down the pump and deactivating the timing means if the maximum time period is exceeded; and d. manually resetting said resettable component to ready the timing means and pump for further operation.

6. The method of claim 5 wherein the step of activating an alarm is performed when said pump is shut down.

* * * * *